US010982379B2

(12) United States Patent
Bombardieri

(10) Patent No.: US 10,982,379 B2
(45) Date of Patent: Apr. 20, 2021

(54) WASHING/DRYING MACHINE WITH A DEVICE FOR CLEANING AN AIR FILTER

(71) Applicant: WHIRLPOOL EMEA S.P.A., Pero (IT)

(72) Inventor: Giovanni Bombardieri, Albino (IT)

(73) Assignee: Whirlpool EMEA S.p.A., Pero (IT)

( * ) Notice: Subject to any disclaimer, the term of this patent is extended or adjusted under 35 U.S.C. 154(b) by 0 days.

(21) Appl. No.: 16/601,027

(22) Filed: Oct. 14, 2019

(65) Prior Publication Data

US 2020/0040514 A1 Feb. 6, 2020

Related U.S. Application Data

(63) Continuation of application No. 15/540,849, filed as application No. PCT/IB2015/059284 on Dec. 2, 2015, now Pat. No. 10,443,181.

(30) Foreign Application Priority Data

Nov. 30, 2014 (IT) ..... TO2014A001122

(51) Int. Cl.

| | |
|---|---|
| ***D06F 25/00*** | (2006.01) |
| ***D06F 39/00*** | (2020.01) |
| ***D06F 39/10*** | (2006.01) |
| ***D06F 58/22*** | (2006.01) |
| ***D06F 58/28*** | (2006.01) |
| ***D06F 58/30*** | (2020.01) |

(52) U.S. Cl.

CPC ..... *D06F 58/22* (2013.01); *D06F 25/00* (2013.01); *D06F 39/00* (2013.01); *D06F 39/10* (2013.01); *D06F 58/30* (2020.02)

(58) Field of Classification Search

CPC ..... D06F 25/00; D06F 39/00; D06F 39/10; D06F 58/22; D06F 58/28; D06F 58/30

USPC ..... 34/552; 68/20

See application file for complete search history.

(56) References Cited

U.S. PATENT DOCUMENTS

| | | | | |
|---|---|---|---|---|
| 10,443,181 | B2 * | 10/2019 | Bombardieri | D06F 58/22 |
| 2010/0154240 | A1 | 6/2010 | Grunert | |
| 2013/0212894 | A1 | 8/2013 | Kim et al. | |
| 2013/0263630 | A1 | 10/2013 | Doh et al. | |

FOREIGN PATENT DOCUMENTS

| | | |
|---|---|---|
| EP | 0816549 A2 | 1/1998 |
| EP | 1647621 A1 | 4/2006 |
| EP | 1907616 A1 | 4/2008 |

(Continued)

OTHER PUBLICATIONS

International Search Report and Written Opinion of the International Searching Authority for Countepart PCT/IB2015/059284, dated March 7, 2016.

*Primary Examiner* — Levon J Shahinian

(74) *Attorney, Agent, or Firm* — McGarry Bair PC

(57) ABSTRACT

The present disclosure relates to a washing/drying machine including a washing/drying chamber, a basket for loading laundry to be treated and housed in the chamber, and a circuit for circulating air taken in from the chamber and then reintroduced therein. The washing/drying machine further includes a filter with a filtering wall having a surface area for filtering the air along the circulation circuit. A filter cleaning device includes a support element provided adjacent to the filtering wall.

20 Claims, 8 Drawing Sheets

(56) References Cited

FOREIGN PATENT DOCUMENTS

| | | | |
|---|---|---|---|
| EP | 2116647 | A1 | 11/2009 |
| EP | 2202349 | A2 | 6/2010 |
| EP | 1775368 | B1 | 2/2011 |
| EP | 2281081 | B1 | 12/2011 |
| EP | 2669417 | A1 | 12/2013 |
| GB | 2154721 | A | 9/1985 |
| WO | 2007000645 | A1 | 1/2007 |

* cited by examiner

WASHING/DRYING MACHINE WITH A DEVICE FOR CLEANING AN AIR FILTER

CROSS-REFERENCE TO RELATED APPLICATIONS

This application is a continuation application of U.S. patent application Ser. No. 15/540,849, filed Jun. 29, 2017, now U.S. Pat. No. 10,332,181, issued Oct. 15, 2019, which claims priority from International Application No. PCT/IB2015/059284, filed Dec. 2, 2015, which claims priority from Italian Application No. TO2014A001122, filed Dec. 30, 2014, all of which are incorporated herein by reference in their entirety.

BACKGROUND

The present disclosure relates to a washing/drying machine, i.e. machines for household, industrial or commercial use intended for washing and drying laundry in general.

These machines, therefore, have some elements in common with washing machines, e.g. the washing tub or chamber that houses a rotary basket or drum; the clothing or, more generally, the laundry to be treated is loaded into the basket through a door, which may be located either at the front or at the top, depending on the machine type.

The rotation of the basket keeps the load moving during the washing and/or drying phases, when the tub is supplied with water and air, respectively.

In the course of the working cycle of the washing/drying machine, the load, consisting of clothing, such as trousers, T-shirts and underwear, or cloths and the like, normally releases filaments that are evacuated through the water drain.

This occurs in a simple and direct manner during the wash, in that water is supplied and drained several times for washing the laundry with detergents, rinsing it, etc., so that the filaments released by the fabrics are removed from the laundry and evacuated together with the water being drained.

BRIEF DESCRIPTION

In one aspect, the present disclosure relates to a washing/drying machine comprising a washing/drying chamber, a basket for loading laundry to be treated and housed in the chamber, a circuit for circulating air taken in from the chamber and then reintroduced therein, and a filter comprising a side wall defining a width of the filter, a filtering wall closing the width of the filter at a front of the side wall and arranged perpendicular to the side wall, the filtering wall having a surface area for filtering the air along the circulation circuit, and a filter cleaning device activated in response to an operating parameter of the washing/drying machine, the filter cleaning device comprising a support element provided within the side wall directly adjacent to the filtering wall, the support element comprising a first arm extending across the width of the filter along the filtering surface area, and a second arm extending across the width of the filter along the filtering surface area, such that the first and second arms intersect along the filtering surface area, wherein each arm has a plurality of nozzles directed at the filtering surface area and oriented at a tangential angle to the filtering surface area and adapted to spray water tangentially onto the filtering surface area, such that water from the first arm sprays in a first direction onto the filtering surface area and water from the second arm sprays in a second direction onto a surface of the filtering surface area whereon filaments get deposited during the circulation of air in the circulation circuit.

DRAWINGS

Such features will become more apparent from the following description of a non-limiting example of aspects thereof as shown in the annexed drawings, wherein.

DESCRIPTION

Figure 1:
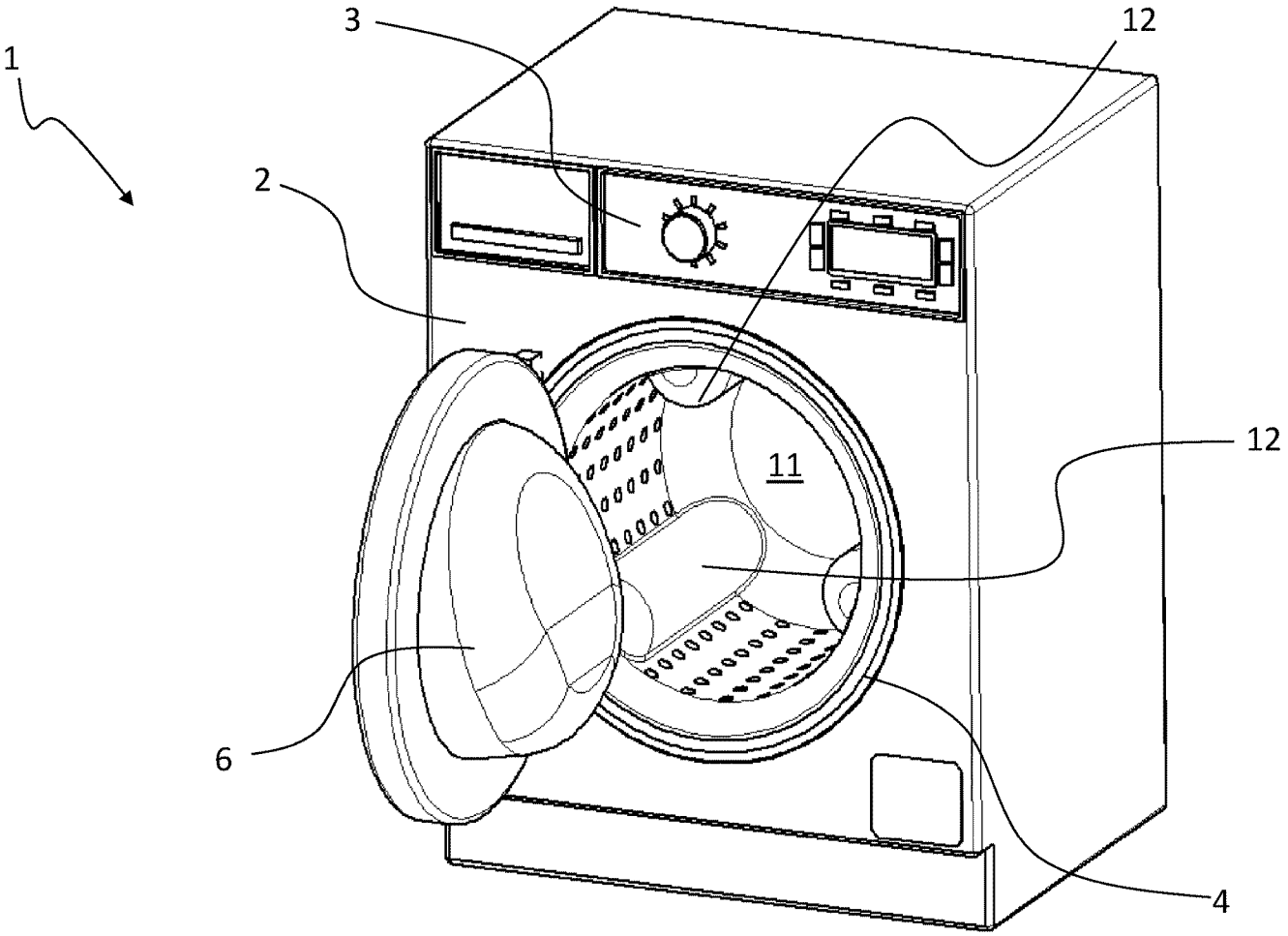
FIG. 1 is a perspective view of a washing/drying machine according to the present disclosure.
Figure 2:
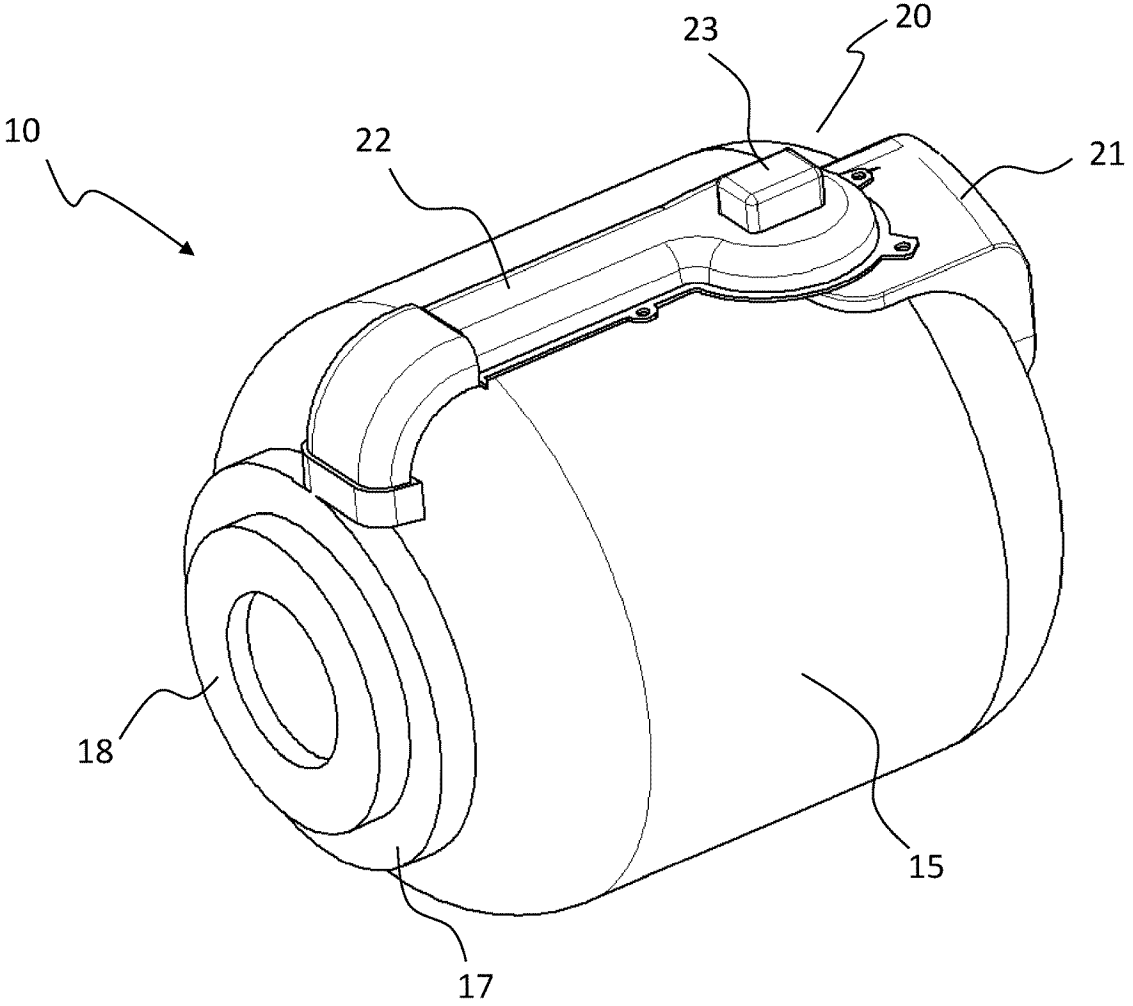
FIG. 2 is a perspective view of the washing/drying tub or chamber of the machine of FIG. 1, with the associated drying circuit.
Figure 3:
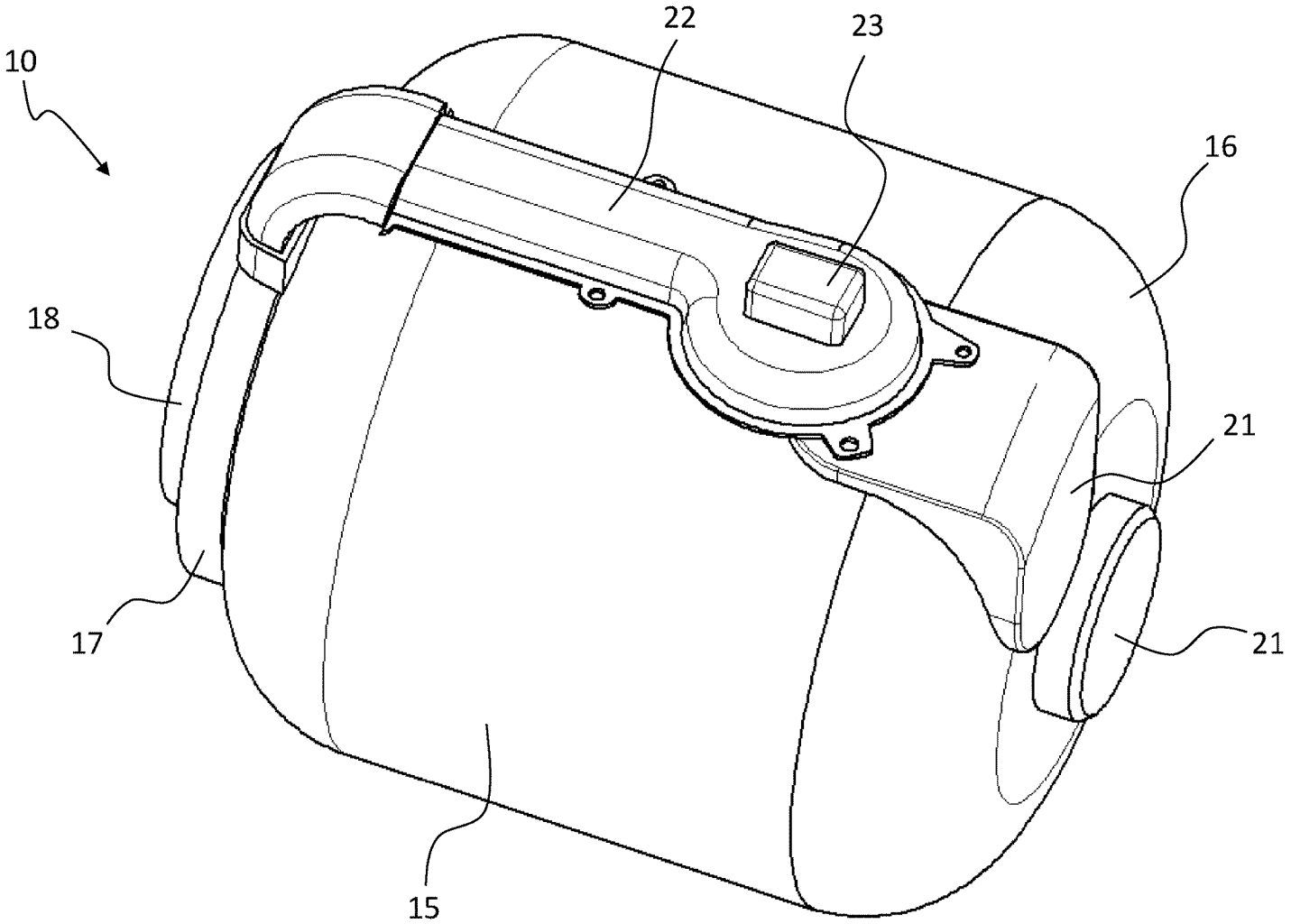
FIG. 3 is a perspective view of the washing/drying tub of the machine of FIG. 1 from a different angle than FIG. 2.

In a combination washer/dryer, after the wash process, when laundry is being dried, the filamentous wads generated by the clothes rubbing against the inner wall of the basket (the quantity of which increases as humidity decreases) are dragged by the air flow that circulates in the machine and laps the laundry items contained in the basket for drying them, but cannot be evacuated in the same way because no water is supplied into the basket during the drying cycle.

As can be easily understood, the drying air must be cyclically filtered to prevent the fan and the associated electric heating resistor, included in the air circuit, from suffering damage.

To this end, it is known to take air from the washing/drying tub, filter it, reduce the humidity thereof, and introduce it again into the tub.

The air is filtered as it flows through a filter comprising a grid or net made of metal, plastic or the like, arranged on a wall of the washing/drying chamber (in particular, on the back wall, at the outlet section towards the drying circuit), the mesh of which is sufficiently tight to trap the filaments released by the fabrics; it can be easily understood that the filamentous wads progressively depositing onto the filter will reduce the air passage section thereof and will cause load losses that will slow down the air flow, resulting in a general reduction of the efficiency of the laundry drying cycle.

The present disclosure aims at overcoming this problem that limits the state of the art.

Therefore, the technical problem at the basis of the present disclosure is to provide a washing/drying machine having such structural and operating characteristics that keep regular and efficient air filtering conditions, so as to ensure the execution of a correct laundry drying cycle.

The idea that solves this problem is to remove from the filter the filaments deposited thereon by the air during the laundry drying cycle: in this way, it is possible to prevent the filter from getting clogged quickly, thus keeping it efficient for a longer time and reducing the load losses and the resulting higher energy consumption of the washing/drying machine.

According to the present disclosure, this is achieved by spraying water onto the filter, in particular on the side thereof where air-borne filaments, fibres, etc. get deposited.

In more detail, with reference to the above-listed drawings, reference numeral 1 designates as a whole a washing/drying machine in accordance with the present disclosure, which comprises an external structure 2 substantially shaped like a parallelepiped cabinet 2, with a front panel 3 equipped with user controls (e.g. push-buttons, knobs, etc.) and various indicators, lamps, displays, or other means such as detergent drawers, useful for the control and operation of the machine 1.

It is worth pointing out that reference will be made in this description, for simplicity and clarity, only to those elements of the washing/drying machine 1 which are useful for understanding the present disclosure; for more information, reference can be made to the prior art, e.g. washing/drying machines created by the present Applicant or described in patent applications filed by the latter on this matter, such as European patent applications EP 2116647, EP 2281081, EP1907616, EP 1775368, EP 1647621 and more, which are integrally recalled herein, and the contents of which should be considered as incorporated in the present description because applicable thereto.

At the front of the cabinet 2 there is the load opening 4 of the washing/drying machine, which is closed by a door 6.

The cabinet 2 of the washing/drying machine internally houses a washing/drying chamber or tub 10, in which a basket 11 for loading laundry to be treated is supported in a per se known manner. The chamber or tub 10 is intended for washing/drying laundry, in that a machine like the one considered herein performs a dual function as a water tub during the washing cycle and as a drying chamber during the drying cycle.

Figure 4:
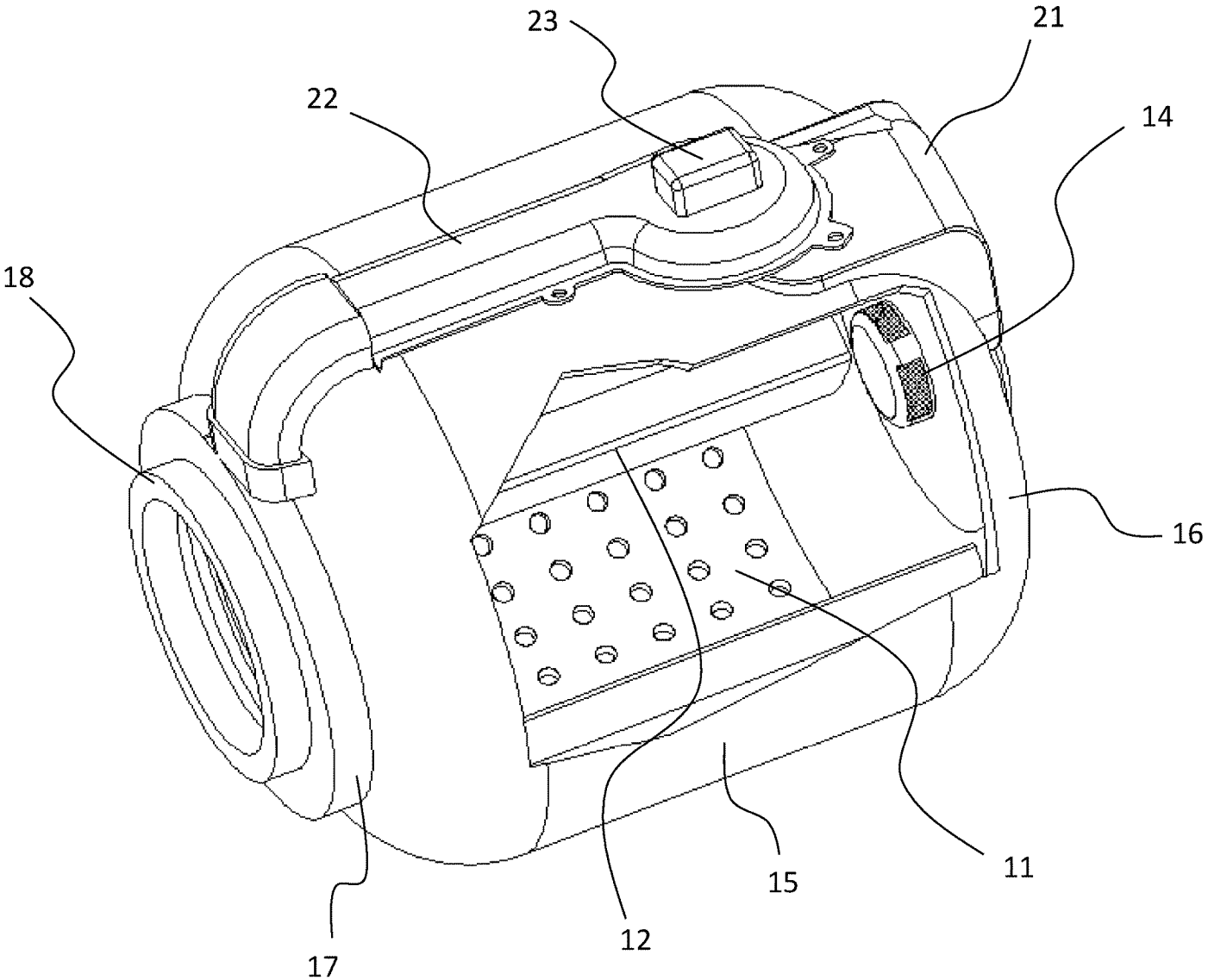
FIG. 4 shows the tub of FIGS. 2 and 3 with a part thereof removed to make the internal parts visible.

The basket 11 has the typical cylindrical drum-like configuration, with a perforated side wall allowing water to flow through, as visible in FIGS. 1 and 4, and is equipped with inner paddles or lifters 12 for stirring the load while rotating when the machine 1 is in operation.

The chamber 10 comprises a substantially cylindrical skirt or side wall 15 (possibly slightly convex), closed at the rear by a back wall 16, while at the front it has a collar 17 on which a gasket 18 is applied, sealing the opening 4 of the cabinet 2 of the washing/drying machine 1.

Outside the chamber 10 a drying air circuit 20 is arranged, which comprises an intake channel 21 (also acting as a condenser) and a delivery channel 22, between which a fan 23 is arranged for air circulation.

In particular, the delivery channel 22 extends from the collar 17 of the chamber 10 to the fan 23, whereas the intake channel 21 extends from the fan 23 to an intake port formed in the back wall 16 of the chamber 10, where there is a filter 25 for the filaments borne by the drying air.

The filter 25 is slightly eccentric relative to the axis of rotation of the basket 11, where the support and/or rotation means of the basket 11, such as shaft, bearings, pulleys, etc. (not shown in the drawings because they are per se known) are applied to the back wall 16 of the chamber 10.

The filter 25 may be designed in any suitable manner, e.g. with a metal or plastic grid or net having a mesh suitable for trapping the filaments released by the laundry being treated in the washing/drying machine 1; the mesh may have a polygonal (e.g. square, rectangular, hexagonal) or circular shape, etc., the mesh size being smaller than 1 $mm^2$.

Figure 5:
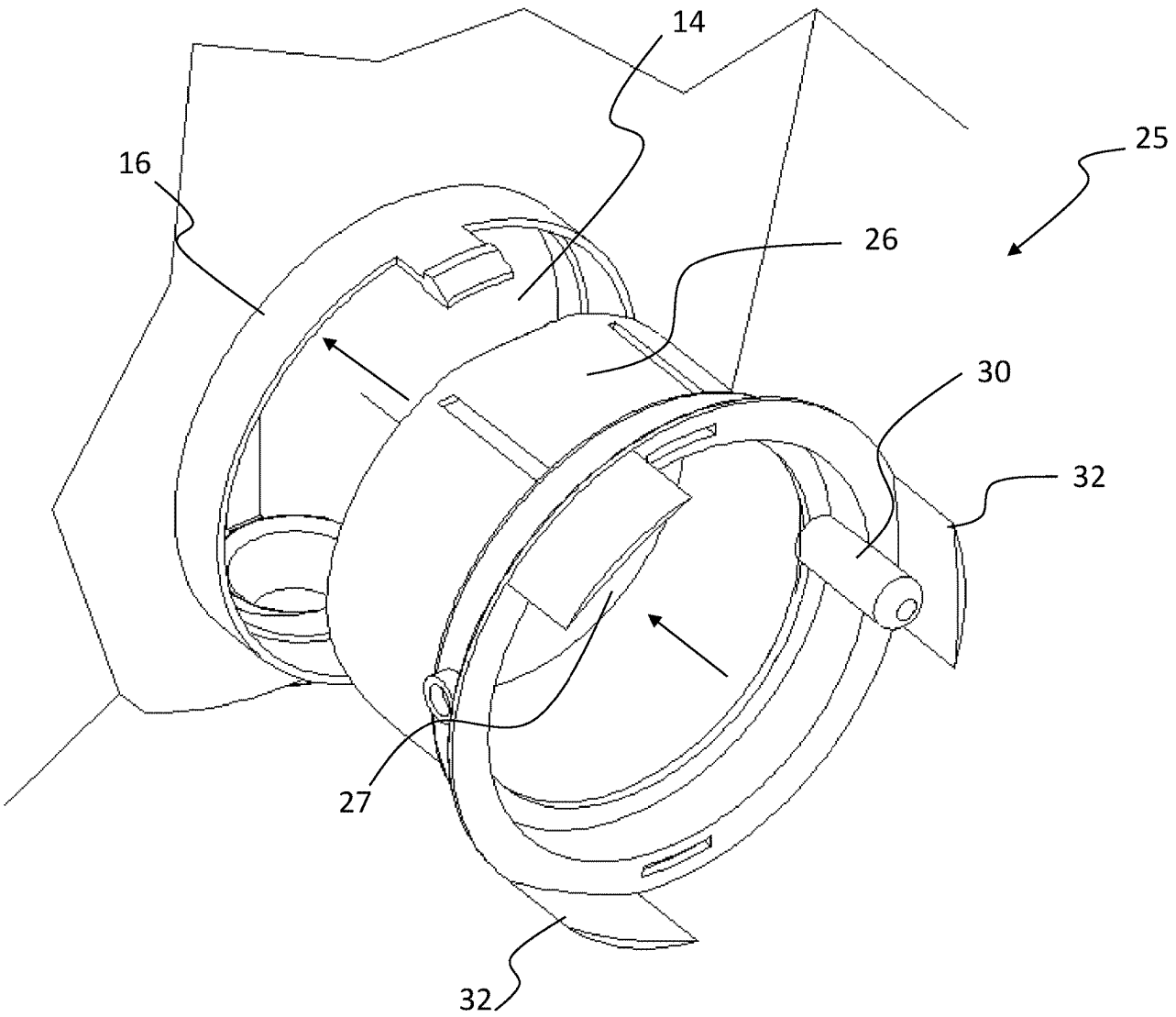
FIG. 5 shows a detail of the filter cleaning device applied to the washing/drying machine of the preceding figures.
Figure 6:
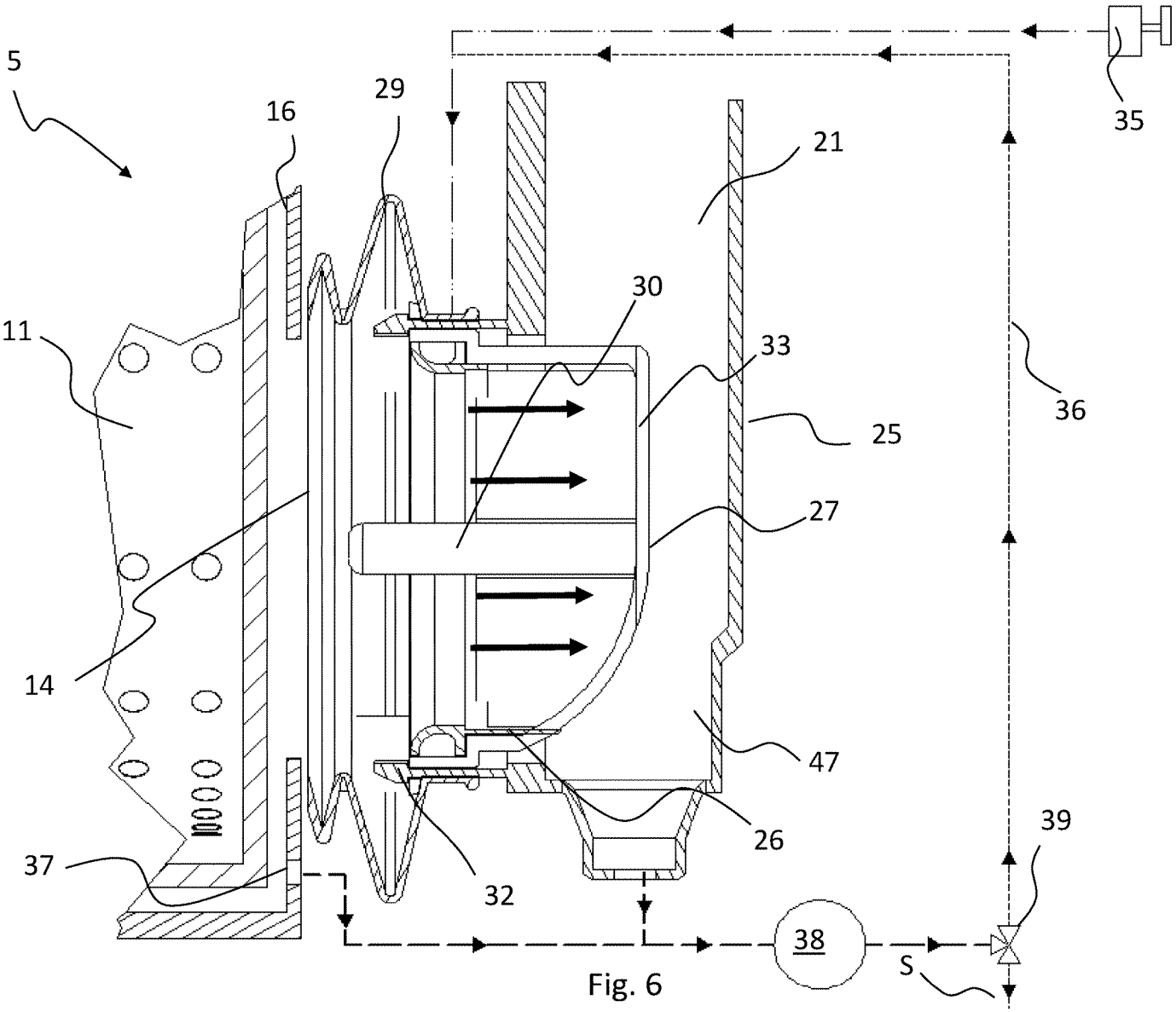
FIG. 6 shows a schematic view of the filter cleaning device of the preceding figures.

In the aspects of FIGS. 5 and 6, the filter 25 is applied to the back wall 16 of the tub 10, at an aperture 14 in the wall 16, and extends into the intake channel 21.

Figure 7:
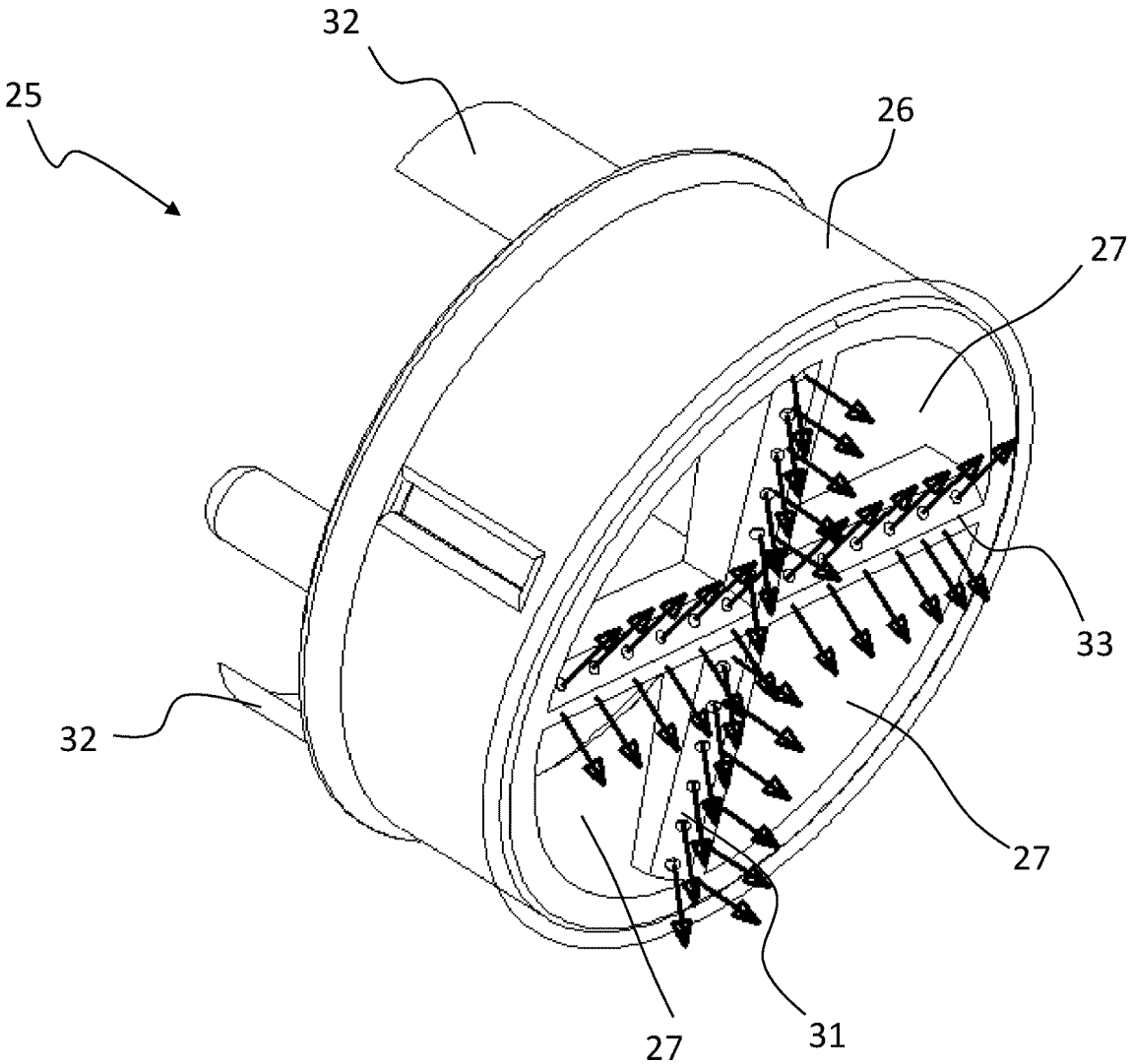
FIGS. 7 and 8 show respective variants of the detail of FIG. 5.

With reference to FIG. 7, the filter 25 shown therein comprises a structure 26 mainly consisting of a substantially cylindrical side wall 26 closed at the front by a filtering wall 27 arranged perpendicular to the cylindrical wall 26.

The structure 26 is applied to the aperture 14 of the back wall, being also equipped with appendices 32 for fitting into the aperture 14 of the back wall 16 of the tub 10.

In accordance with the present disclosure, the structure of the filter 25 comprises the nozzles 31, which in this example are advantageously mounted to a support spider 33 located on the front wall of the cylindrical structure of the filter, where there is also the filtering wall 27.

The latter is divided by the spider 33 into four sectors of a circle having a central angle of 90°: their number may however vary, whether smaller or greater than four, if different configurations are adopted, other than the spider-shaped one, for the support element 33 where the nozzles are arranged. Thus, for example, there may be three sectors having a central angle of 120° when using a three-arm sunburst-pattern element, or six sectors when using a six-arm sunburst-pattern element, and so on.

What it important is that the nozzles 31 arranged on the spider-shaped support 33 will spray water onto the filtering sectors or walls 27 in a manner substantially tangential thereto, as previously explained.

For this purpose, the filter 25 is axially equipped with a fitting 30 connected to a hydraulic circuit comprising, among other things, an intake tap or electrovalve 35, a recirculation branch 36, and a pump 38.

In particular, the intake tap or electrovalve 35 is connected to or anyway associated with the water mains that supplies water to the washing/drying machine 1, which is provided with a branch 36 for recirculating the water extracted from the bottom of the washing/drying chamber 10 through a first drain 37.

The connection between the electrovalve 35 and the nozzles 31 may or may not include an air break, and the jets from the nozzles 31 must have sufficient pressure to effectively hit the filter 25 and its filtering walls 27.

The cylindrical wall 26 with the nozzles 31 is at least partly housed in the intake and condensation channel 21, which is secured to the back wall 16 of the washing chamber 10; advantageously, in the lower part of the intake channel 21 there is a second drain 47 for the water sprayed by the nozzles 31 (as well as for the condensed water created by the condenser in the channel 21).

Thus, the water collected by gravity on the bottom of the channel 21 will be evacuated into the recirculation branch 36; in this regard, it must be pointed out that the vertical arrangement of the intake channel 21, resulting from its application to the back wall 16, will promote the evacuation by gravity from the drain 47 towards the recirculation branch 36.

To this end, in accordance with a preferred aspect, the device 5 for cleaning the filter 25 allows the water, especially the condensed water generated during the laundry drying stage, to be recirculated into the branch 36 by a pump 38 that gives it sufficient pressure to clean the filter 25.

In this case, along the hydraulic circuit there is also a diverting valve 39, which can direct the flow either towards the drain S or into the recirculation branch 36, to be then delivered again to the nozzles 31.

In fact, when the water is contaminated by filaments, the valve 39 will direct it towards the drain S, otherwise it will be reused for a filter cleaning cycle.

The filter 25 is installed at the aperture 14 on the back 16 of the washing chamber 10. Tightness is preferably ensured by means of a gasket 29.

In particular, the filter 25 is applied in such a way that the filtering wall 27 with the nozzles 31 will face towards the inside of the chamber 10, so that, when cleaning is activated, the nozzles 31 will spray water against the filtering wall 27 on the side thereof facing towards the chamber 10.

Preferably, the water jets are emitted by the nozzles 31 in a direction tangential to the sectors of the filtering wall 27, and remove the filaments deposited thereon through the effect of the hydrodynamic action of the water; in this regard, it must be pointed out that the spider 33 is slightly lower than the filtering wall 27: therefore, the supply pressure of the nozzles 31 will be relatively low, so that the water can drip on the filtering wall.

Figure 8:
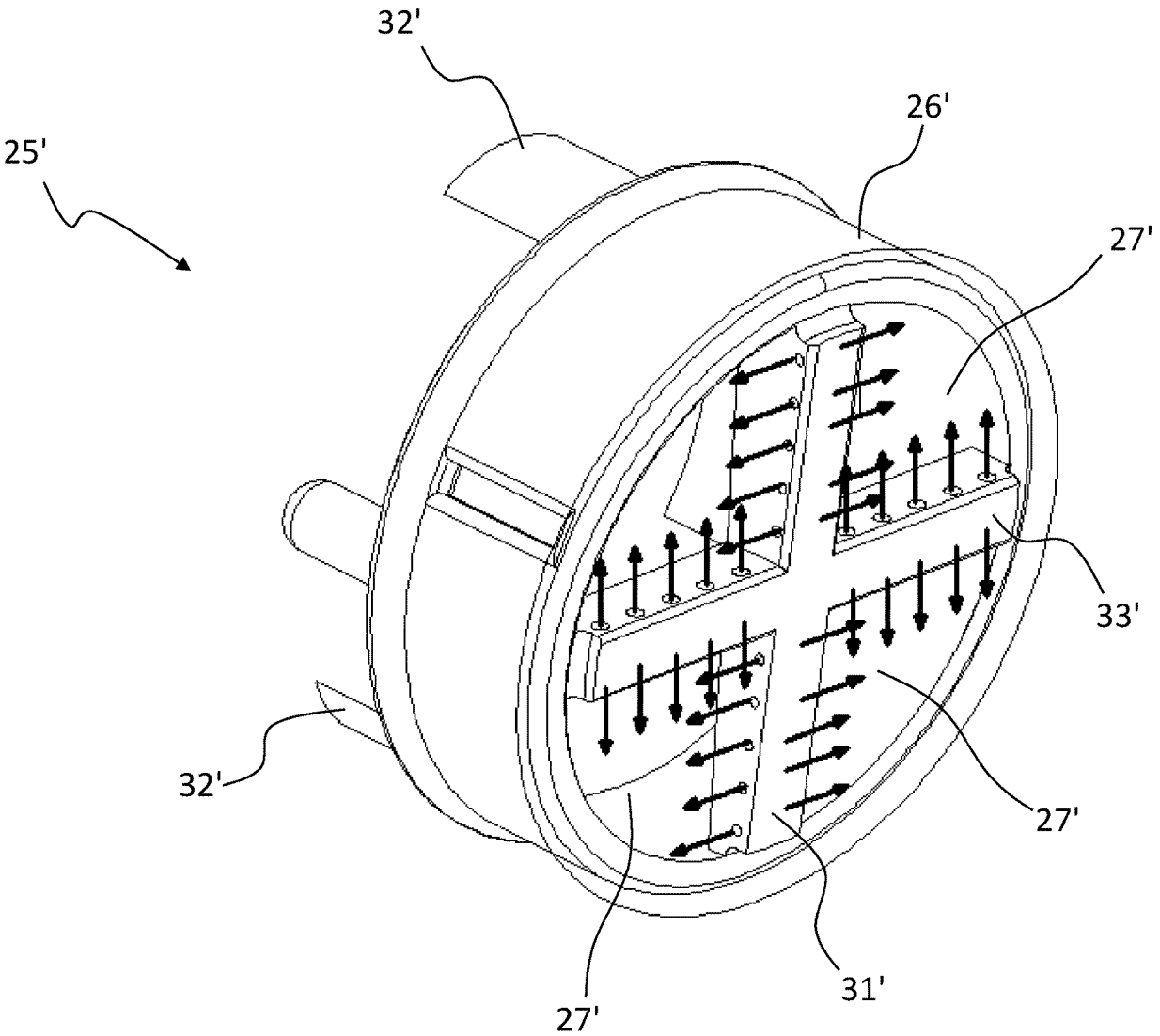

In the variant shown in FIG. 8, where the items are designated by the same numbers with the addition of an apostrophe, the pressure of the water sprayed by the nozzles 31' can be higher because the spider 33' protrudes relative to the filtering wall 27': in this case, the water jets will be directed against the filtering wall 27' of the filter 25' at a small angle of incidence.

Filaments will also be removed through the effect of the greater hydrodynamic force offered by this solution.

It must nevertheless be pointed out that in both of the aspects shown in FIGS. 7 and 8 water is sprayed onto the filtering wall 27 or 27', respectively, on the side thereof facing towards the inside of the tub 10, i.e. the side whereon filaments borne by the laundry drying air get deposited.

It follows that, even if the water fed to the nozzles comes from outside the tub 10, i.e. from the mains via the intake tap 35 or from the recirculation branch 36, it will then be sprayed by the nozzles 31, 31' onto that side of the filtering walls 27, 27' which faces towards the inside of the tub, or anyway on which the filaments coming from the inside of the tub get deposited when air is taken in.

Therefore, the filaments removed by the water will fall into the tub 10 or onto the bottom of the intake channel 21, so that they can be easily removed through the drain S.

Finally, it should be noted that the variants of the filter 25, 25' and of the nozzles 31, 31', which spray water as described, can be combined together in order to create a further variant; in this case, there will be a protruding spider 33 with nozzles 31 and 31' associated therewith as explained above.

In the light of the above explanation it is possible to understand the operation of the washing/drying machine 1 according to the present disclosure, especially as concerns the device 5 for cleaning the filter 25, whereas as regards the washing and drying functions the following description will only tackle those aspects that may be useful for understanding the present disclosure; for further details, therefore, reference should be made to the operation of the washing/drying machines known in the art.

When, during an operating cycle of the washing/drying machine, the filter 25 becomes clogged with filaments released by the laundry being treated, the cleaning device 5 will be activated to spray water from the nozzles 31 against the filtering walls 27 of the filter 25, so as to remove the filaments deposited thereon.

In particular, as indicated by the arrows in FIGS. 7 and 8, the nozzles 31 spray water into the filter 25, preferably directing the jet in a manner substantially tangential to the filtering walls 27 or anyway at a small angle of incidence relative to the surface of the latter; in this description and in the appended claims, the angle of incidence refers to the angle defined by the direction of a water jet and by the profile of the filtering wall 27 against which the jet is directed.

This way of spraying water promotes the removal of the filaments deposited on the filtering walls 27, while at the same time avoiding the application of excessive hydrodynamic pressure onto them, which might otherwise damage them, as it would happen if the jet were directed perpendicularly to the filtering surface.

It should be noted, in fact, that when the filtering surfaces 27 are thin (e.g. made out of braided wires or synthetic fabrics) and/or have a small and thick mesh, the action of a jet directed perpendicularly against them might deform them because of its hydrodynamic pressure, thereby jeopardizing their efficiency and reliability.

It should also be highlighted that, in accordance with the present disclosure, the water jets sprayed by the nozzles are directed inside the filter 25, i.e. the part thereof whereon filaments get deposited: this ensures a more effective removal action, because the water jets will directly act upon the filaments.

In this respect, it must be pointed out that the Applicant has been able to verify the effectiveness of this solution with water jets directed inside the filter, compared to the solution wherein the water jets are external, i.e. water is sprayed onto the side of the filtering walls opposite to that on which filaments get deposited.

Once removed, the filaments are evacuated along with the cleaning water through the drain 37 of the washing chamber 10.

Note that, depending on the operating steps of the washing/drying machine 1, the cleaning water may be water coming from the household mains, supplied through the tap 35, or recirculated water coming from the branch 36 that collects the condensed water created by the drying air in the intake channel 21.

The management of the filter cleaning water, i.e. mains water or recirculated water, essentially depends on the mode in which the filter is to be cleaned.

For example, the cleaning device 5 may be made to operate continuously during the drying step or, in order to optimize water consumption, it may operate in an intermittent and/or impulsive manner, in which case the device 5 will only be activated during particular time intervals in the course of the drying step, or, alternatively, in the course of one or more substeps specifically dedicated to the cleaning of the filter 25.

Preferably, the cleaning device 5 is turned on at the end of a drying cycle, or anyway before a new wash cycle begins; in such circumstances, with the machine empty or with a small load in the basket 11, water will be supplied to the nozzles 31 from the mains when the intake tap 35 is opened.

According to a preferred mode of controlling the device 5, this will be activated when the relative humidity in the chamber 10 falls below a preset threshold.

It will be only from then onwards, in fact, that filaments, fibres, lint or bobbles will be released from the laundry in a significant amount. For example, one may conceive a pulsed activation of the device 5 when a residual humidity of 10% is reached in the chamber 10, with a duty cycle depending on the pressure and/or flow of the water supplied to the nozzles 31. The residual humidity in the tub can be sensed in a known manner, e.g. by applying the teachings of patent application GB2154721A.

The filter will then be washed with mains water, which will then be evacuated from the tub bottom through the drain S; in this case, the diverting valve 39 will send the nozzle washing water directly towards the drain.

If on the contrary no filaments are found in the water, the latter can be reused for washing the filter 25; this working cycle may be carried out either in a programmed manner, i.e. with a certain timing or after a certain number of drying cycles of the machine 1, or in a controlled manner, through the use of suitable sensors.

For example, let us consider the case wherein one wants to detect any leakage in the circuit 20 of the drying air; this detection can be made either by means of suitable pressure sensors or by reading the values of the electric power absorbed by the electric motor that drives the fan 23.

When the absorbed power reaches certain preset levels, this means that the filter is clogged and requires the removal of the filaments deposited thereon.

As an alternative, the condition of the filter 25 can be controlled by means of optical sensors: the presence of filaments deposited on the filter will prevent the passage of luminous signals, and this condition can be detected by means of optical sensors, so that a cleaning cycle can then be started as explained above.

Of course, the present disclosure may be subject to other variations with respect to the description provided so far.

In fact, although the example shown in the drawings is structurally and functionally simple, thus being preferable because it is economically advantageous, the use of different solutions should not be excluded as concerns the nozzles and their supply system.

What is claimed is:

1. A washing/drying machine comprising:

a washing/drying chamber;

a basket for loading laundry to be treated and housed in the chamber;

a circuit for circulating air taken in from the chamber and then reintroduced therein; and a filter comprising:

a side wall defining a width of the filter;

a filtering wall closing the width of the filter at a front of the side wall and arranged perpendicular to the side wall, the filtering wall having a surface area for filtering the air along the circulation circuit; and a filter cleaning device activated in response to an operating parameter of the washing/drying machine, the filter cleaning device comprising a support element provided within the side wall directly adjacent to the filtering wall, the support element comprising:

a first arm extending across the width of the filter along the filtering surface area; and a second arm extending across the width of the filter along the filtering surface area, such that the first and second arms intersect along the filtering surface area;

wherein each arm has a plurality of nozzles directed at the filtering surface area and oriented at a tangential angle to the filtering surface area and adapted to spray water tangentially onto the filtering surface area, such that water from the first arm sprays in a first direction onto the filtering surface area and water from the second arm sprays in a second direction onto a surface of the filtering surface area whereon filaments get deposited during the circulation of air in the circulation circuit.

2. The washing/drying machine of claim 1 wherein the filter cleaning device is activated in response to a cycle of operation of the washing/drying machine.

3. The washing/drying machine of claim 2 wherein the filter cleaning device is activated continuously during a drying step of the cycle of operation.

4. The washing/drying machine of claim 2 wherein the filter cleaning device is activated intermittently during particular time intervals or substeps of the cycle of operation.

5. The washing/drying machine of claim 4 wherein the filter cleaning device is activated at an end of a drying step of the cycle of operation.

6. The washing/drying machine of claim 4 wherein the filter cleaning device is activated prior to a new wash cycle of operation.

7. The washing/drying machine of claim 1 wherein the filter cleaning device is activated in response to a sensed parameter of the washing/drying machine.

8. The washing/drying machine of claim 7 wherein the sensed parameter is a sensed humidity and the filter cleaning device is activated when the sensed humidity in the washing/drying chamber falls below a preset threshold.

9. The washing/drying machine of claim 8 wherein the preset threshold is 10% humidity.

10. The washing/drying machine of claim 8 wherein the sensed humidity is relative humidity or residual humidity.

11. The washing/drying machine of claim 7 wherein the sensed parameter is a sensed pressure in the circulation circuit.

12. The washing/drying machine of claim 7 wherein the circulation circuit comprises a fan driven by an electric motor.

13. The washing/drying machine of claim 12 wherein the sensed parameter is a value of the electric power absorbed by the electric motor and the filter cleaning device is activated when the absorbed electric power reaches a preset level.

14. The washing/drying machine of claim 7 wherein the sensed parameter is a presence of filaments on the filtering wall that is detected by an optical sensor.

15. The washing/drying machine of claim 1 wherein the second arm is orthogonal to the first arm such that the first and second arms divide the filtering surface area into at least four quadrants.

16. The washing/drying machine of claim 15 wherein the plurality of nozzles are directed at each of the at least four quadrants.

17. The washing/drying machine of claim 1 wherein the side wall has substantially cylindrical geometry and defines a diameter of the filter.

18. The washing/drying machine of claim 1 wherein the side wall includes appendices for coupling with the chamber.

19. The washing/drying machine of claim 1 wherein the filtering surface area has a center and the first and second arms form a spider shape along the center to form a spider-shaped support element.

20. The washing/drying machine of claim 1 wherein the filtering surface area has a center and the first and second arms form an X shape along the center.

* * * * *